US005595503A

United States Patent [19]

Pittman et al.

[11] Patent Number: 5,595,503

[45] Date of Patent: Jan. 21, 1997

[54] ROTATABLE ELECTRICAL PLUG AND POWER CORD

[75] Inventors: Carl R. Pittman, Westfield; Wendell Ison, Columbus, both of Ind.

[73] Assignee: Woods Industries, Inc., Carmel, Ind.

[21] Appl. No.: 476,126

[22] Filed: Jun. 7, 1995

[51] Int. Cl.[6] ..... H01R 13/56

[52] U.S. Cl. ..... 439/446; 439/11; 439/164

[58] Field of Search ..... 439/11, 694, 310, 439/484, 20, 135, 22, 10, 466, 169

[56] References Cited

U.S. PATENT DOCUMENTS

| | | | |
|---|---|---|---|
| 1,238,448 | 8/1917 | Shaw . | |
| 1,714,763 | 5/1929 | Boyson . | |
| 1,817,004 | 8/1931 | Hubbell, Jr. | 439/694 |
| 1,950,036 | 3/1934 | Preston . | |
| 1,975,964 | 10/1934 | Mayhew . | |
| 1,984,181 | 12/1934 | French . | |
| 2,226,209 | 12/1940 | Rizzuto . | |
| 2,326,181 | 8/1943 | Sundquist et al. | 439/694 |
| 2,425,679 | 8/1947 | Jackson . | |
| 2,433,938 | 1/1948 | Varner . | |
| 2,542,609 | 2/1951 | Wyglendowski . | |
| 2,869,102 | 1/1959 | Hubbell, Jr. . | |
| 2,892,172 | 6/1959 | McGann, Jr. . | |
| 2,898,572 | 8/1959 | Shinn . | |
| 3,032,740 | 5/1962 | Hoorn . | |
| 3,137,536 | 6/1964 | Healy . | |
| 3,335,395 | 8/1967 | Smith . | |
| 3,474,376 | 10/1969 | Preiss . | |
| 3,479,632 | 11/1969 | Galles . | |
| 3,718,890 | 2/1973 | Sheldon . | |
| 3,747,049 | 7/1973 | Cressman et al. . | |
| 3,950,069 | 4/1976 | Wiley . | |
| 3,975,075 | 8/1976 | Mason . | |
| 4,026,618 | 5/1977 | Straka . | |
| 4,771,367 | 9/1988 | Serr et al. . | |
| 4,927,376 | 5/1990 | Dickie . | |
| 5,114,352 | 5/1992 | Gahagen et al. . | |
| 5,399,093 | 3/1995 | Schneider et al. . | |

*Primary Examiner*—Gary F. Paumen
*Assistant Examiner*—Christopher Goins
*Attorney, Agent, or Firm*—McAndrews, Held & Malloy, Ltd.

[57] ABSTRACT

A rotatable electrical plug and power cord for mating with a conventional electrical outlet comprises a housing first portion and a housing second portion rotatably coupled to the housing first portion. The housing first portion carries first and second electrically conductive outlet prongs extend from the housing first portion a sufficient distance to permit the prongs to engage into an electrical outlet. The housing second portion is connected to the proximal end of a power cord such that the power cord can rotate relative to the prongs. The power has a pair of electrical conductors extending between its proximal and distal ends. A flexible conductor means electrically interconnects the power cord conductors with the respective prongs and permits the housing first portion to rotate relative to the housing second portion without imparting forces on the power cord conductors. The flexible conductor means may comprise a pair of multiwire conductors, each of which extends between a power cord conductors and a respective prongs. The multiwire conductors are substantially more flexible than the conductors traditionally used in a power cord and, as a result, are able to withstand the bending and twisting forces imparted on them during rotation of the housing portions relative to each other.

21 Claims, 3 Drawing Sheets

FIG. 4
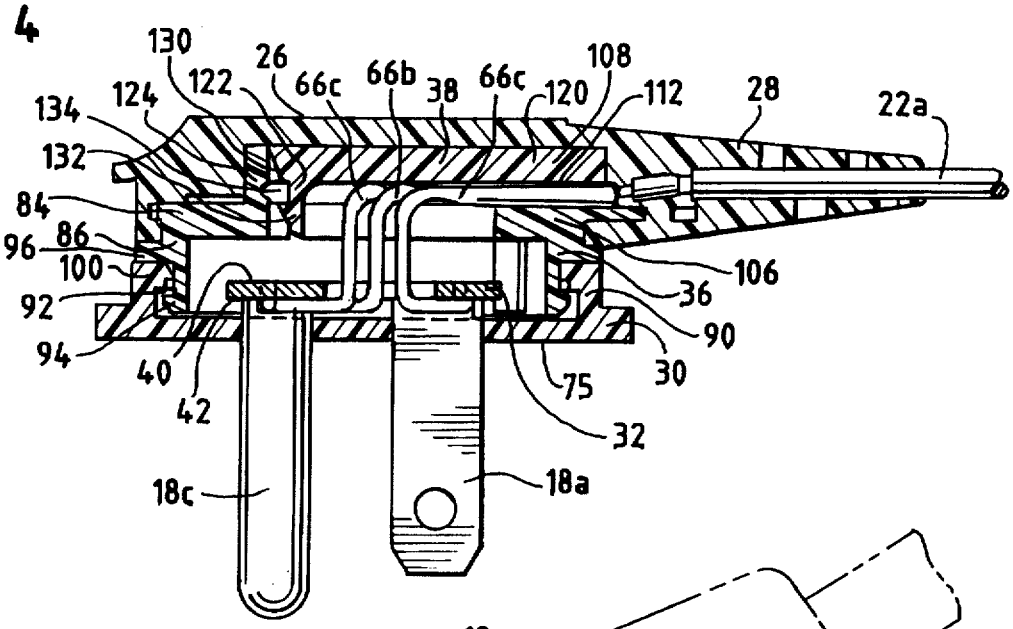
FIG. 5
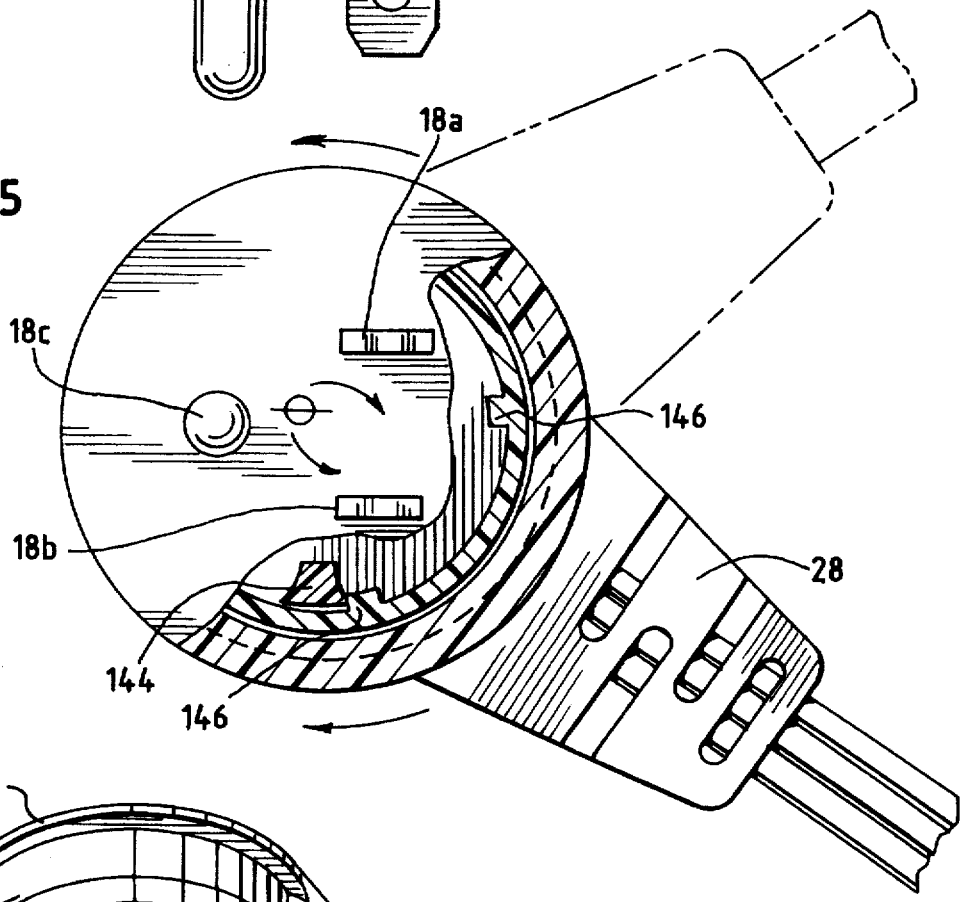
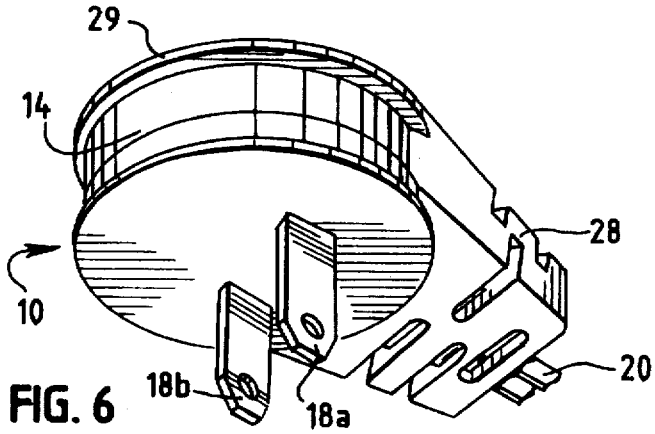
FIG. 6

ROTATABLE ELECTRICAL PLUG AND POWER CORD

FIELD OF THE INVENTION

The present invention relates generally to an electrical plug and, more particularly, to an electrical plug in which the power cord is rotatable relative to the electrical prongs carried by the plug housing.

BACKGROUND OF THE INVENTION

Conventional electrical plugs are undesirable because they typically include a housing which protrudes a substantial distance from the wall once the plug is inserted into the outlet. This protrusion makes the plug susceptible to unintentional disengagement by moving objects and also prevents furniture and other objects from being placed close to the wall.

Over the years a variety of plugs have been developed which have low profile housings (hereinafter referred to as "low profile plugs"). Low profile plugs are advantageous because they have a reduced housing profile in comparison to conventional electrical plugs. As such, they are less susceptible to unintentional disengagement and permit objects to be placed closer to the wall than is possible with conventional plugs.

In most low profile plugs, the power cord exits the plug perpendicular to the prongs so as to decrease the profile of plug's housing. Hence, when the plug is inserted into a wall outlet, the power cord exits the plug housing parallel to the face of the wall outlet. These plugs are undesirable because it is possible for the cord to block other receptacles in the outlet, thereby preventing additional plugs from being inserted into the outlet. This is even more of a problem with polarized plugs or plugs incorporating a ground prong since these plugs can only be inserted into the wall outlet in one orientation.

In recognition of this problem, it is known to orient the electrical cord to ensure that it does not overlay the other receptacles in the outlet. Examples of such designs are illustrated in U.S. Pat. Nos. 4,927,376 issued to Dickie and 3,975,075 issued to Mason. Dickie discloses a low profile plug in which the cord exits the plug body at an acute angle with respect to a vertical axis of the plug. The cord then passes through a sleeve that reorients the cord with the vertical axis. Similarly, Mason discloses a profile plug in which the cord exits tangentially from a circular plug housing at such an angle that it does not overlay the other receptacles in a standard wall outlet. When several plugs are inserted into a single wall outlet, such plug designs are undesirable because all of the cords leave the outlet in the same direction. As such it is difficult to route electrical cords in several directions from a single wall outlet without entangling the various cords. Besides being unsightly, tangled electrical cords should be avoided because they can be dangerous.

This problem can be addressed by a plug design in which the cord rotates with respect to the prongs. In addition to addressing the above problems, a rotatable plug allows the electrical device connected to the plug to be moved relative to the outlet without imparting excessive forces on the prongs of the plug.

Numerous designs for rotatable plugs have been proposed in the past. In one known design, annular conductors are used to interconnect the power cord with the electrical prongs. Some plugs of this design do not provide for more than two electrical prongs. As a result, these plugs are not suitable for devices requiring a grounding prong. Moreover, plugs of this design are difficult and costly to manufacture and they often fail to meet applicable safety standards, such as those established by the United Laboratories (hereinafter "UL").

An alternative to the above design is to directly connect the power cord conductors to the prongs. This latter design is not acceptable, however, because it can impose excessive bending forces on the power cord conductors. As a result, plugs of this design may have an undesirably short operating life and may also fail to meet applicable safety standards.

Accordingly, an object of the present invention is to provide an electrical plug in which the power cord is rotatable relative to the prongs carried by the plug's housing.

Another object of the present invention to provide a rotatable plug which meets the applicable UL standards.

A further object of the present invention is to provide a rotatable electrical plug which has a reduced housing profile when compared to conventional electrical plugs.

Still a further object of the present invention is to provide an electrical plug and power cord combination in which the power cord can be rotated relative to the plug's prongs without imparting forces on the power cord conductors.

Another object of the present invention to provide a rotatable electrical plug which can incorporate two electrical prongs or three electrical prongs without substantial design changes or manufacturing set up changes.

Still another object of the present invention to provide a profile rotatable plug which is economical and simple to manufacture.

Other objects and advantages of the invention will become apparent upon reading the following detailed description and appended claims, and upon reference to the accompanying drawings.

SUMMARY OF THE INVENTION

The above and other objects and advantages are achieved by a rotatable electrical plug and power cord for mating with a conventional electrical outlet comprising a housing first portion having an planar exterior surface. First and second electrically conductive outlet prongs are rigidly secured to the housing first portion and extend perpendicularly from its planar exterior face a sufficient distance to permit the prongs to engage into an electrical outlet. A power cord has first and second electrical conductors extending between its proximal and distal ends. A housing second portion is rigidly affixed to the proximal end of the power cord and rotatably coupled to the housing first portion such that the power cord can rotate relative to the electrical prongs. A flexible conductor means electrically interconnects the first and second power cord conductors with first and second prongs, respectively, and permits the housing first portion to rotate relative to the housing second portion without imparting forces on the power cord conductors.

The flexible conductor means may comprise first and second multiwire conductors, each of which has a first end physically and electrically connected to a respective power cord conductor and a second end physically connected to the housing second portion and electrically connected to a respective electrical prong. The multiwire conductors preferably have a length which is greater than the distance between their point of connection with the power cord and their point of connection with the electrical prongs to permit free rotation of the housing portions relative to each other. The multiwire conductors are substantially more flexible than the conductors traditionally used in a power cord, and, as a result, they are able to withstand the bending and twisting forces imparted during rotation of the housing portions relative to each other. Preferably, the rotatable plug includes a means for limiting rotation of the power cord relative to the prongs to an angle less than 360 degrees, thereby reducing the forces imposed on the flexible connector means. The plug components are adapted to "snap" together during assembly, thereby adding to the manufacturability of the plug. The housing second portion may comprise a cord clamp assembly having first and second portions adapted to clamp around the junction of the multiwire conductors and the power cord to increase the physical integrity of this junction.

BRIEF DESCRIPTION OF THE DRAWINGS

For a more complete understanding of this invention reference should now be had to the embodiment illustrated in greater detail in the accompanying drawings and described below by way of example of the invention.

In the drawings:

FIG. 4 is a cross-sectional view of the electrical plug along lie 4—4 of FIG. 1.

FIG. 5 is a partial bottom cross-section view of the electric plug of FIG. 1 illustrating a travel limiting means.

FIG. 6. is a bottom perspective view of a two-prong rotatable electric plug in accordance with the present invention.

DETAILED DESCRIPTION OF THE PREFERRED EMBODIMENTS

In the following detailed description, spatially orienting terms are used such as "left," "right," "upward," "downward," and the like. It is to be understood that these terms are used for convenience of description of the preferred embodiments by reference to the drawings. These terms do not necessarily describe the absolute location in space, such as left, right, upward, downward, etc., that any part must assume.

Figure 7:
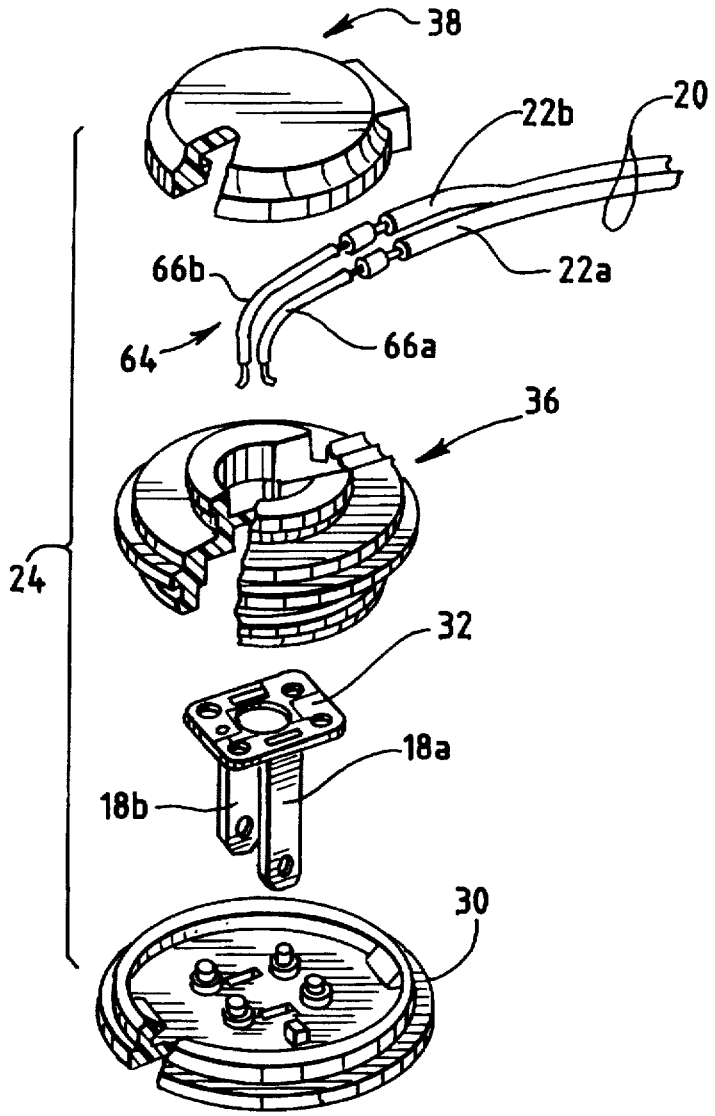
FIG. 7 is a partial exploded perspective view of the electrical plug of FIG. 6.

Referring to FIGS. 1–5, a three-prong embodiment of a rotatable electrical plug 10 includes a housing 14 which supports three electrical prongs 18*a*, 18*b*, 18*c* or blades oriented for insertion into a conventional electrical outlet. Specifically, the three-prong electrical plug includes a hot or live prong 18*a*, a common or neutral prong 18*b*, and a ground prong 18*c*. A two-prong version of the rotatable electrical plug is illustrated in FIGS. 6 and 7, and is explained in greater detail below.

Figure 1:
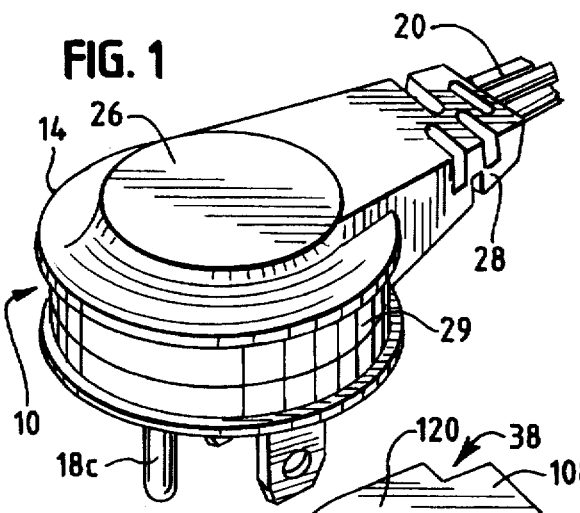
FIG. 1 is a top perspective view of a three-prong rotatable electric plug in accordance with the present invention.
Figure 2:
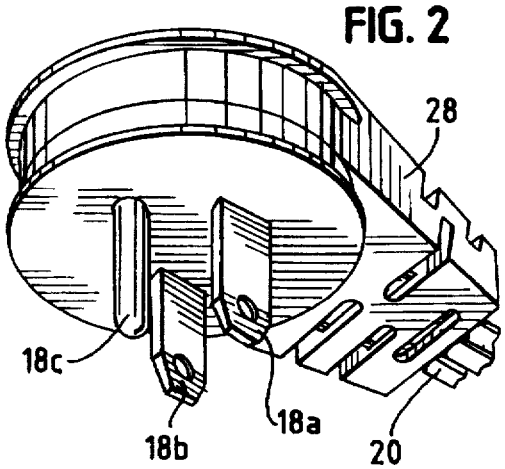
FIG. 2 is a bottom perspective view of the electrical plug of FIG. 1.
Figure 3:
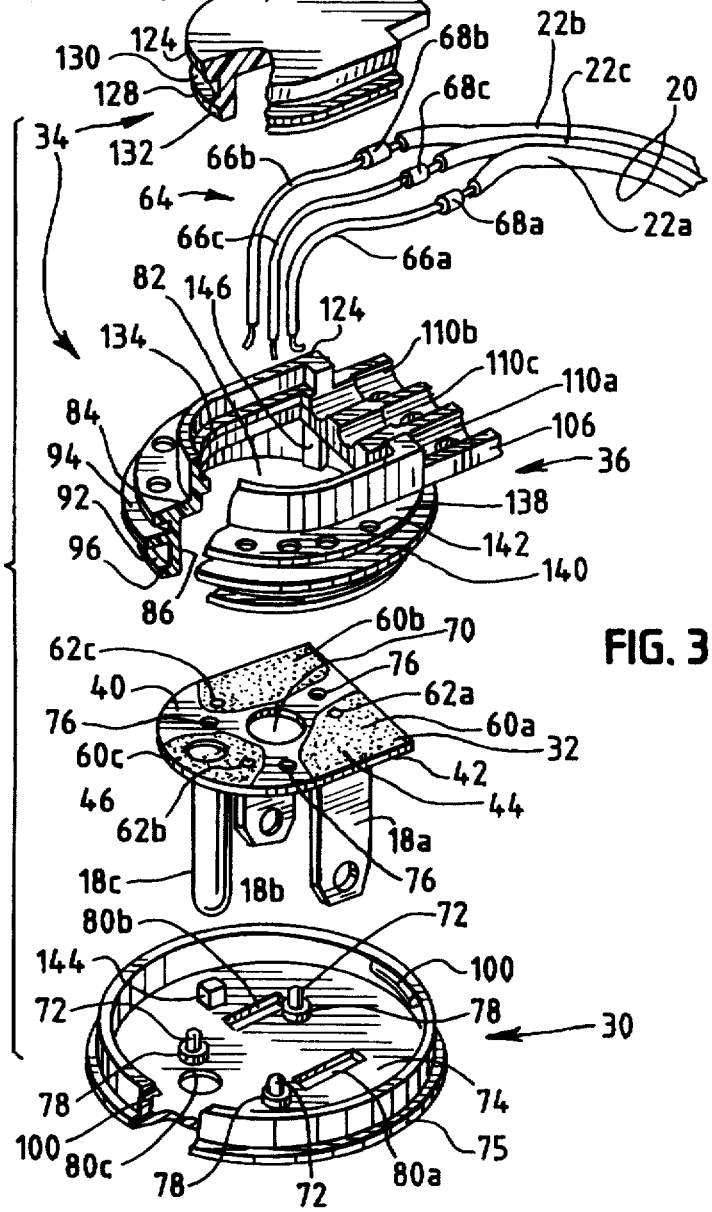
FIG. 3 is a partial exploded perspective view of the electrical plug of FIG. 1.

An insulated power cord 20 has its proximal end connected to the housing 14 and its distal end may, for example, terminate in a female electrical conductor (not shown) or it may be connected directly to an electrical device (not shown), such as a home appliance or power tool, for delivering electrical power thereto. As shown in FIG. 3, the power cord 20 includes a live conductor 22*a*, a neutral conductor 22*b*, and a ground conductor 22*c*. The proximal end of each power cord electrical conductor 22*a*, 22*b*, 22*c* is electrically connected to a respective prong 18*a*, 18*b*, 18*c*, whereas the distal ends of the conductors are suitably connected to the device connected to the distal end of the power cord.

As can best be seen in FIGS. 3 and 4, the housing 14 is generally cylindrical and comprises a lower subassembly 24 (See FIG. 3) and an upper portion or body 26 which is molded about the lower subassembly. The upper portion 26 is molded from a nonconductive material such as polyvinylchloride (PVC) and preferably includes an integral strain relief 28 which extends about power cord 20 at its junction with the housing 14. The molded upper portion 26 includes an integral lip 29 which can be used to grasp the plug 10 to facilitate its removal from an outlet.

The lower subassembly 26 comprises a bottom closure member 30, a prong support plate 32, and a cord clamp assembly 34 which further comprises a cord clamp base 36 and a cord clamp top 38. The support plate 32 is formed of a rigid, nonconductive material and is configured to support the prongs 18 within the housing 14 to orient the prongs for insertion into a conventional electrical outlet, and facilitate electrical interconnection of the prongs with the power cord 20. Preferably, the support plate 32 is made from a conventional printed circuit board (PCB) material and is in the form of a thin sheet having a flat top face 40 and a flat bottom face 42.

The support plate 32 includes a generally rectangular portion 44 which carries the live and neutral prongs 18*a*, 18*b* and an arcuate portion 46 which carries the ground prong 18*c*. The prongs 18 are designed to snap into prong receiving apertures 48 (one shown in FIG. 8) which extend through the support plate 32 between its top and bottom faces 40, 42. The interface between the prongs 18 and the support plate 32 is similar to that described in U.S. patent application Ser. No. 08/436,700, filed May 8, 1995, for a "Low Profile Electrical Plug," the disclosure of which is hereby incorporated by reference.

Figure 8:
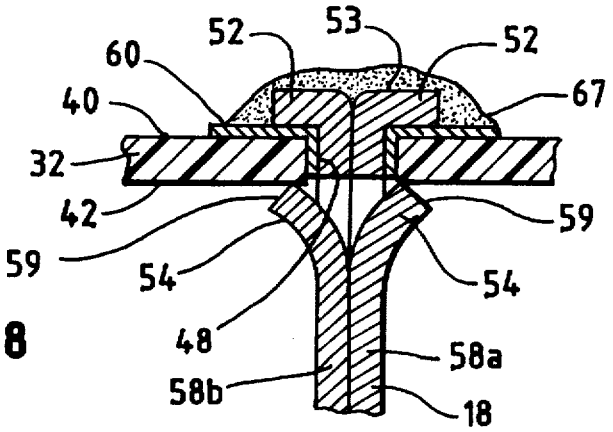
FIG. 8 is a perspective view of an electrical prong used in the electrical plug of FIGS. 1–7.

As can best be seen in FIG. 8, the prongs 18*a*, 18*b*, 18*c* are slid into the prong receiving apertures 48 in the support plate 32 during the assembly of plug 10. The prongs 18 are located and locked into place by tabs 52, 54 formed in the upper end 53 of each prong. Specifically, each prong 18 includes at least one stop tab 52 and at least one locking tab 54. The stop tabs 52 serve to limit the distance that the prong 18 is inserted into the support plate 20. As shown in FIG. 8, the prongs 18*a*, 18*b* may be formed from two side by side pieces of stamped metal 58*a*, 58*b*, and the stop tabs 52 may be formed from bending the upper ends of the stamped metal prongs perpendicularly from the longitudinal axis of a respective prong 18.

The locking tabs 54 are space apart from, and located below, the stop tabs 52 by a distance which is approximately equal to the thickness of the support plate 32. The locking tabs 54 are cut and bent out from the stamped metal prongs. The locking tabs 54 are normally biased outwardly from a respective prong 18 and are compressible inwardly to allow the prong 18 to slide into the prong receiving apertures in the support plate 32. Once the top ends 59 of the locking tabs 54 pass through the prong receiving aperture, the locking tabs 54 snap outwardly to lockingly secure the prong 18 into support plate 32. Prongs made in accordance with the above description are commercially available from Heyco Manufacturing of 1800 Industrial Way N., Toms River, N.J.

Referring again to FIG. 3, paths or traces 60 of electrically conductive material such as copper are disposed on one face of the support plate 32. The traces 60 extend between prong receiving apertures and respective connection apertures 62*a*, 62*b*, 62*c*. The three-prong plug shown in FIGS. 1–5 includes a live trace 60*a*, a neutral trace 60*b*, and a ground trace 60*c*. Preferably, the conductive traces 60 are screen printed onto the top face 40 of support plate 32; however, it is foreseeable to form the conductive traces 60 using methods such as etching, insertion molding or compression molding. Each conductive trace 60 extends around the perimeter a respective prong receiving aperture, to provide a good electrical connection to the prongs 18 when prongs 18 are inserted into the support plate apertures. Traces 60 are preprinted onto support plate 32 to form a subassembly of support plate 32 and traces 60.

Once the prongs 18 are connected to the support plate 32, the power cord conductors 22*a*, 22*b*, 22*c* are electrically coupled to the respective prongs 18*a*, 18*b*, 18*c* via a flexible electrical coupling means 64. The flexible electrical coupling means 64 permits rotation of the power cord 22 relative to the prongs 18 without straining the power cord conductors 22. If the power cord conductors 22 were directly connected to the prongs 18, the conductors 22 could eventually break due to repeated bending.

The flexible coupling means 64 comprises flexible wire extensions 66 which are connected to the proximal ends of the power cord conductors 22 by wire crimps 68. It should be appreciated that the power cord conductors 22 and the flexible extensions 66 could be interconnected by other methods such as soldering. In the three-prong version, the flexible coupling means comprises a live flexible extension 66*a*, a neutral flexible extension 66*b* and a ground flexible extension 66*c*. The flexible extensions 66 exhibit a greater flexibility than traditional power cord conductors and are designed to be able to pass the UL498/UL817 standard. Under this standard, the plug was subjected to 2500 rotation cycles in which the prongs were rotated from position A in FIG. 5 to position B and then back to position A. As is explained below, this results in the prongs being rotated 270 degrees (in each direction) relative to the power cord 20. The flexible extensions 66 utilize a finely braided, multiwire construction. A suitable configuration for the extensions 66 in a 15 amp power cord is a soft copper conductor with PVC insulation having 665 strands of 44 gage wire. This configuration produces a conductor which is equal to an AWG 16 assembly.

The flexible extensions 66 are routed through a center aperture 70 in the support plate 32 and the other ends of the extensions 66*a*, 66*b*, 66*c* are then rerouted up through the respective connection apertures 62*a*, 62*b*, 62*c*. The ends of the conductors are then secured to the support plate 32 by soldering, for example. The solder preferably extends over the stop tabs 52 to secure the prongs 18 into the apertures 48, as indicated by element 67 in FIG. 8. The solder also ensures a good electrical connection between the conductors 66*a*, 66*b* and 66*c* and a respective conductive trace 60*a*, 60*b*, 60*c* (and, hence, a respective prong 18*a*, 18*b*, 18*c*).

Once the prongs 18 and flexible extensions 66 are connected to the support plate 32, the support plate is lowered into and secured to the bottom closure member 30. The bottom closure member 30 includes a plurality of stakes 72 extending upwardly from the inner surface 74 of its bottom wall 75. The stakes 72 are oriented to align with and extend through reciprocal apertures 76 formed in the support plate 32. The bottom portions of the stakes 72 have a larger diameter than the apertures 76 and form shoulders 78 which abut against the bottom face 42 of the support plate 32 and support it above the bottom wall 75. Once the support plate 32 is positioned on the stakes 72, the upper ends of the stakes are melted to secure the support plate to the bottom closure member 30. The bottom closure member 30 also includes prong apertures 80*a*, 80*b*, 80*c* which extend through its bottom wall 75 and are positioned to align with respective ones of the prongs 18*a*, 18*b*, 18*c*. The prongs 18 extend through the apertures 80 and from the bottom wall 75, a sufficient distance to engage into a powered outlet.

After the support plate 32 is secured to the bottom closure 30, the power cord 20 is routed through a center aperture 82 in the cord clamp bottom 36 and the cord clamp bottom is connected to the bottom closure member. The cord clamp bottom 36 has a top wall 84 and an annular sidewall 86 extending downwardly from the top wall. The top wall 84 and the sidewall 86 define an interior compartment 88 (see FIG. 4) sized to fit around the support plate 32.

The sidewall 86 is sized to fit within a reciprocal annular sidewall extending 90 upwardly from the bottom wall 75 of the bottom closure member 30. The sidewall 86 on cord clamp bottom 36 includes a recess 92 defined by first and second vertically spaced, outwardly extending radial flanges 94, 96. The inner surface of the sidewall 90 includes a plurality (three) inwardly extending tabs 100 which are configured to lockingly and slidingly engage with the recess 92 to rotatably connect the bottom closure member 30 to the cord clamp bottom 36. The first radial flange 94 has a greater outer diameter than the annular sidewall 90, and, as a result, the upper edge of the sidewall 90 supportingly engages against the lower surface of the first flange 94 (see FIG. 4).

The flexible extensions 66*a*, 66*b*, 66*c* extend up through the center aperture 82 in the cord clamp bottom 36 and are clamped between mating clamping portions 106, 108 formed in the cord clamp top and bottom. Specifically, the cord clamp bottom 36 includes a bottom clamping portion 106 which extends outwardly from its top wall 84, whereas the cord clamp top 38 includes a top clamping portion 108 which extends outwardly from its top wall and is positioned to align with the bottom clamping portion 106. The upper surface of the bottom clamping portion 106 defines three semicircular recesses 110*a*, 110*b*, 110*c* positioned to align with reciprocal recesses 112 (one shown in FIG. 4) formed in the lower face of the upper clamping portion 108. The inner portions of the recesses 110 have a smaller diameter than the outer diameter of the flexible connectors 66, and, as a result, the flexible connectors are compressed between the upper and lower clamping portions 106, 108 when the cord clamp top 38 is connected to the cord clamp bottom (see FIG. 4).

As can be seen in FIG. 4, the bottom clamping portion 106 extends outwardly beyond the top clamping portion 108. The wire crimps 68 are positioned in the recesses 110 in the bottom clamping portion 106 outwardly of the top clamping portion 108. Apertures 114 extend through the cord clamp lower portion and intersect the recesses 110 at the proximity of the wire crimps. As a result, the molded material which forms the upper housing 26 flows into recesses and surrounds the wire crimps. As can be seen in FIG. 4, the multiwire conductors preferably have a length which is greater than the distance between their point of connection with the power cord and their point of connection with the electrical prongs to permit free rotation of the housing portions relative to each other.

The cord clamp top 38 is designed to lockingly engage within the cord clamp bottom 36 during assembly. For this purpose, the cord clamp top 38 comprises a top wall 120 and a downwardly extending, generally u-shaped sidewall 122 which is sized to engage within a reciprocal wall 124 extending upwardly from the top wall of the cord clamp bottom. The u-shape of the sidewall 122 and the upwardly extending wall 124 prevents the cord clamp bottom and top 36, 38 from rotating relative to each other. The sidewall 122 on cord clamp top 38 includes a recess 128 defined by an upper and lower vertically spaced space, outwardly extending flanges 130, 132. The inner surface of the upwardly extending wall 124 includes an inwardly extending rib 134 which is sized and positioned to lockingly engage in the recess 128. The lower edge of the lower flange 130 is beveled to ease insertion of the cord clamp top 38 into the cord clamp bottom 36.

With the cord clamp top 38 affixed to the cord clamp bottom 36, the lower subassembly 24 is complete and the upper body 26 can be molded about the lower subassembly. The cord clamp bottom 36 includes a second recess 140 defined by the space between the first radial flange 94 and a third radial flange 138 which is upwardly spaced from the first radial flange. The third radial flange 138 may include a plurality of apertures 142 extending therethrough. The molded material forming the upper body 26 flows into the second recess 140 and the apertures 142 in the third flange 138 during the molding process to further secure the upper body to the lower subassembly 24.

The plug 10 may include a means for limiting the rotation of the power cord 20 relative to the prongs 18 to a range less than 360 degrees. As can be seen in FIGS. 3 and 5, the means comprises an upward extension 144 formed in the in the inner surface of the bottom wall 75 of the bottom closure member 30. This extension interfaces with a pair spaced apart extensions or stops 146 formed in the inner surface of the cord clamp bottom 36 to limit rotation of these components to approximately 270 degrees.

FIGS. 6 and 7 illustrate a two-prong embodiment of electric plug 10. The design of the two-prong plug is very similar to the design of the three-prong plug. Hence, the same reference numbers which were used in FIGS. 1–5 are used to identify like components in FIGS. 6 and 7, and only a brief description of the differences between the two plugs is provided. The main differences are a result of the decreased number of prongs in the two-prong plug. Specifically, because there are only two prongs 18*a*, 18*b* and two power cord conductors 22*a*, 22*b*, the support plate 32 only has two prong receiving apertures and the cord clamp is designed to clamp around two conductors as opposed to three. In addition, the support plate can be made smaller in the two-prong plug. Specifically, the arcuate portion 46 which carries the ground prong 18*c* in the three-prong plug can be eliminated, resulting in a rectangular shape as shown in FIG. 7.

As can be appreciated from the above description, the design of the present rotatable plug makes it possible to produce both two-prong and three-prong plugs without any substantial design changes. As a result, it is more economical to produce both two-prong and three-prong versions of the electrical plug.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A rotatable electrical plug and power cord for mating with a conventional electrical outlet, comprising:

a housing first portion;

first and second electrically conductive outlet prongs extending from the housing first portion a sufficient distance engagement into an electrical outlet;

a power cord having a proximal end and a distal end and first and second electrical conductors extending between its proximal and distal ends;

a housing second portion rigidly affixed to the proximal end of the power cord and rotatably coupled to the housing first portion such that the power cord can rotate relative to the electrical prongs; and flexible conductor means for electrically interconnecting the first and second power cord conductors with the first and second prongs, respectively, and for permitting the housing first portion to rotate relative to the housing second portion without imparting forces on the power cord conductors.

2. A rotatable electrical plug and power cord as set forth in claim 1, wherein the housing second portion further comprises a cord clamp assembly having first and second portions adapted to clamp around the flexible means at or near its junction with the power cord.

3. A rotatable electrical plug and power cord as set forth in claim 2, wherein the housing second portion further comprises an outer body molded around the clamping assembly.

4. A rotatable electrical plug and power cord as set forth in claim 3, further comprising a strain relief formed at the junction of the power cord and the housing second portion.

5. A rotatable electrical plug and power cord as set forth in claim 4, wherein the strain relief orients the power cord such that it extends approximately perpendicular to the axis of the prongs.

6. A rotatable electrical plug and power cord as set forth in claim 1, further comprising means for limiting rotation of the power cord relative to the prongs to an angle less than 360 degrees.

7. A rotatable electrical plug and power cord as set forth in claim 1, wherein the means limits rotation of the power cord relative to the prongs to an angle which is approximately 270 degrees.

8. A rotatable electrical plug and power cord as set forth in claim 1, wherein the flexible conductor means comprises first and second multiwire conductors, each multiwire conductor having a first end physically and electrically connected to a respective power cord conductor and a second end physically connected to the housing second portion and electrically connected to a respective electrical prong.

9. A rotatable electrical plug and power cord as set forth in claim 8, further comprising a pair of conductive traces carried by the housing second portion, each conductive trace extending between and electrically connecting the second end of one of the multiple wire connectors and a respective prong.

10. A rotatable electrical plug and power cord as set forth in claim 8, wherein the multiwire conductors have a length which is greater than the distance between their point of connection with the power cord and their point of connection with the electrical prongs.

11. A rotatable electrical plug and power cord as set forth in claim 1, wherein the housing first portion further comprises a bottom closure member adapted to rotatably engage with the housing second portion, and a support plate carried by the bottom closure and being adapted to physically support the electrical prongs.

12. A rotatable electrical plug and power cord as set forth in claim 11, wherein the support plate comprises a printed circuit board.

13. A rotatable electrical plug and power cord for mating with a conventional electrical outlet, comprising:

a housing first portion;

first and second electrically conductive prongs extending from the housing first portion a sufficient distance for engagement into an electrical outlet;

a power cord having a proximal end and a distal end and first and second conductors extending between its proximal and distal ends;

first and second multiwire conductors, each multiwire conductor having a first end physically and electrically connected to a respective power cord conductor and a second end electrically connected to a respective electrical prong;

a cord clamp assembly statably connected to the housing first portion, the cord clamp assembly having first and second portions adapted to clamp around the first ends of the multiple wire conductors to fix their position relative to the cord clamp.

14. A rotatable electrical plug and power cord as set forth in claim 13, wherein the housing first portion and the cord clamp include respective annular sidewalls adapted to rotatably engage with each other.

15. A rotatable electrical plug and power cord as set forth in claim 13 further comprising a molded portion encasing at least a portion of the clamp assembly and extending about its junction with the power cord proximal end.

16. A rotatable electrical plug and power cord as set forth in claim 13, wherein the housing first portion comprises a bottom closure member defining a bottom wall and the annular sidewall, and a planar support plate carried by the bottom closure member and being spaced apart from its bottom wall, the support plate being adapted to the support the conductive prongs permit their electrical interconnection with the multiwire conductors.

17. A rotatable electrical plug and power cord as set forth in claim 14, further comprising a pair of conductive traces disposed on the support plate, each conductive trace extending between and electrically connecting the second end of one of the multiwire connectors and a respective prong.

18. A rotatable electrical plug and power cord as set forth in claim 15, wherein the support plate comprises a printed circuit board.

19. A rotatable electrical plug and power cord as set forth in claim 12, wherein the multiwire conductors have a length which is greater than the distance between their point of connection with the power cord and their point of connection with the electrical prongs.

20. A rotatable electrical plug and power cord as set forth in claim 12, further comprises an outer body molded around the clamping assembly.

21. A rotatable electrical plug and power cord as set forth in claim 12, means for limiting rotation of the power cord relative to the prongs to an angle less than 360 degrees.

* * * * *